US005386181A

United States Patent [19]

Orenstein

[11] Patent Number: 5,386,181

[45] Date of Patent: Jan. 31, 1995

[54] SWEPT FREQUENCY SWITCHING EXCITATION SUPPLY FOR GAS DISCHARGE TUBES

[75] Inventor: Edward D. Orenstein, Edina, Minn.

[73] Assignee: Neon Dynamics Corporation, Minnetonka, Minn.

[21] Appl. No.: 825,629

[22] Filed: Jan. 24, 1992

[51] Int. Cl.[6] ..... H05B 41/29; H05B 41/36; H05B 41/44

[52] U.S. Cl. ..... 315/287; 315/219; 315/223; 315/226; 315/291; 315/220; 315/225

[58] Field of Search ..... 315/209 R, 219, 220, 315/223, 225, 226, 291, 287, DIG. 4

[56] References Cited

U.S. PATENT DOCUMENTS

| | | | |
|---|---|---|---|
| 1,819,105 | 8/1931 | Machlett et al. . | |
| 1,854,912 | 4/1932 | Spaeth . | |
| 2,056,464 | 10/1936 | Jones | 315/287 |
| 2,629,839 | 2/1953 | Greenlee . | |
| 2,708,251 | 5/1955 | Rively . | |
| 2,984,765 | 5/1961 | Engelbart . | |
| 3,050,654 | 8/1962 | Toulon . | |
| 3,059,149 | 10/1962 | Salisbury . | |
| 3,085,189 | 4/1963 | Thonemann et al. . | |
| 3,196,312 | 7/1965 | Marrison . | |
| 3,767,970 | 10/1973 | Collins . | |
| 3,882,356 | 5/1975 | Stehlin . | |
| 3,883,778 | 5/1975 | Kaji et al. . | |
| 3,990,000 | 11/1976 | Digneffe . | |
| 4,005,330 | 1/1977 | Glascock, Jr. et al. . | |
| 4,047,077 | 9/1977 | Veith . | |
| 4,048,541 | 9/1977 | Adams et al. . | |
| 4,158,793 | 6/1979 | Lewis . | |
| 4,168,453 | 9/1979 | Gerhard et al. . | |
| 4,219,760 | 8/1980 | Ferro . | |
| 4,230,971 | 10/1980 | Gerhard et al. . | |
| 4,238,710 | 12/1980 | Nelson . | |
| 4,245,178 | 1/1981 | Justice . | |
| 4,253,046 | 2/1981 | Gerhard et al. . | |
| 4,266,165 | 5/1981 | Handler . | |
| 4,337,464 | 6/1982 | Karaila et al. . | |
| 4,373,146 | 2/1983 | Bonazoli et al. . | |
| 4,376,912 | 3/1983 | Jernakoff . | |
| 4,475,064 | 10/1984 | Burgess . | |
| 4,511,195 | 4/1985 | Barter . | |
| 4,612,479 | 9/1986 | Zansky . | |
| 4,631,449 | 12/1986 | Peters . | |
| 4,663,570 | 5/1987 | Luchaco et al. . | |
| 4,682,084 | 7/1987 | Juhnel et al. . | |
| 4,697,122 | 9/1987 | Hoffer | 315/151 X |
| 4,700,111 | 10/1987 | Folwell et al. . | |
| 4,742,278 | 5/1988 | Iannini . | |
| 4,745,342 | 5/1988 | Andresen et al. . | |
| 4,862,042 | 8/1989 | Herrick | 315/291 |
| 4,870,326 | 9/1989 | Andresen et al. . | |
| 4,891,561 | 1/1990 | Amano et al. | 315/223 |
| 4,916,362 | 4/1990 | Orenstein . | |
| 4,926,097 | 5/1990 | Tack | 315/DIG. 4 X |
| 4,980,611 | 12/1990 | Orenstein . | |
| 5,041,767 | 8/1991 | Doroftei et al. . | |

FOREIGN PATENT DOCUMENTS

| | | |
|---|---|---|
| 066927 | 12/1982 | European Pat. Off. . |
| 68014 | 10/1973 | Luxembourg . |
| 8606572 | 11/1986 | WIPO . |

*Primary Examiner*—David Mis

*Attorney, Agent, or Firm*—Schwegman, Lundberg & Woessner

[57] ABSTRACT

The present invention describes a method and apparatus for a swept frequency switching gas discharge tube supply which produces a "crawling effect" in gas discharge tubes containing neon, argon or mercury gases or other gases and which has a means for eliminating the "bubble effect". To produce the "crawling effect", the driving frequency of the switching supply is swept from a higher frequency to a lower frequency thereby causing the excitation point to move from the electrodes on both ends of the dual electrode gas discharge tube to the center of the gas discharge tube. By varying the base switching frequency of the supply, the bubble effect which plagues some displays can be eliminated.

5 Claims, 2 Drawing Sheets

SWEPT FREQUENCY SWITCHING EXCITATION SUPPLY FOR GAS DISCHARGE TUBES

FIELD OF THE INVENTION

The present invention applies to the field of excitation of gas discharge tubes and more particularly to swept frequency switching power supplies used for exciting neon, argon, mercury, and the like, gas discharge tubes and to methods and apparatus for producing the "crawling" excitation effect in such tubes.

BACKGROUND OF THE INVENTION

The most popular gas discharge tubes in use for displays are the types which use neon gas or a combination of argon and mercury gases. The neon gas when excited glows at a characteristic red color. The combination of argon and mercury gases when excited typically glow in a pale blue color. All other colors used in display signs are typically phosphor-coated tubes in which argon and mercury gases are placed. The argon-mercury vapors are excited which in turn cause the phosphors to glow. The phosphors then glow at the selected color.

Excitation power supplies for gas discharge tubes and in particular for neon or argon-mercury discharge tubes, have been known for many years. The most common form of a discharge supply is a neon light transformer having a 60 Hz, 120 volt AC primary with 60 Hz approximately 10 KVAC secondary which is directly connected to the electrodes attached to either end of the gas discharge tube. A transformer of this size tends to weigh 10–20 pounds due to the massive core, the number of primary and secondary windings and the potting of the transformer in a tar-like material to prevent arcing. This results in a very larger bulky and unsightly excitation supply.

More recently, light-weight switching power supplies have been used to step up the 60 Hz, 120 VAC voltage to a higher frequency for conversion to a higher voltage for exciting gas discharge tubes. In general, the higher switching frequency allows the use of smaller, more light-weight transformers. The switching frequency may be fixed or may be variable as described in U.S. Pat. No. 4,916,362 issued Apr. 10, 1990 entitled Excitation Supply for Gas Discharge Tubes to Edward D. Orenstein which is assigned to the same assignee of the present invention, and which is hereby incorporated by reference.

It is known in the art to create a "crawling effect" gas discharge tubes as described in U.S. Pat. No. 4,742,278, issued May 3, 1988 entitled Single Connection Gas Discharge Display and Driver to Robert E. Iannini. This crawling effect causes the excitation of the gas in the gas discharge tube to start at one end of the tube and grow to the other end. In U.S. Pat. No. 4,742,278, this effect is accomplished in gas discharge tubes having only a single connection. The growth of the excitation along the length of the tube is accomplished by ramping the voltage on the input of the single connection to the tube. In order to accomplish this single ended connection on the tube, the power source must be connected using a polarized plug to ensure that one side of the power supply is reference to earth ground. Floating supplies are specifically prohibited from this technique.

Also described in U.S. Pat. No. 4,742,278, is that means for effecting the crawling effect is by varying the voltage of a fixed frequency switching power supply.

As described in U.S. Pat. No. 4,916,362, fixed frequency power supplies are limited in the types of gas discharge tubes that can be driven due to the "bubble effect". The bubble effect is caused by alternating light and dark sections a gas discharge tube due to fixed frequency harmonics for impedance mismatches between the driving power supply and the gas discharge tube. Thus a wide variety of gas discharge tubes cannot be used with a single fixed frequency supply due to the occasion of the bubble effect.

Therefore, there is a need in the prior art for a high frequency switching gas discharge tube supply which provides a "crawling effect" in gas discharge tubes containing neon, argon, mercury gases or other gases for a two electrode tube and which operates independent of the polarity of the line supply mains. There is also a need in the prior art for a swept frequency switching gas discharge tube supply which provides a "crawling effect" in gas discharge tubes by sweeping the excitation frequency of the drive signal.

SUMMARY OF THE INVENTION

To overcome the shortcomings described above, and to overcome other shortcomings that will be understood by those skilled in the art upon reading and understanding the present specification. The present invention describes a method and apparatus for a swept frequency switching gas discharge tube supply which produces a "crawling effect" in dual electrode gas discharge tubes containing neon, argon or mercury gases or other gases and which has a means for eliminating the "bubble effect". To produce the "crawling effect", the frequency of the switching supply is swept from a higher frequency to a lower frequency thereby causing the excitation point to move from the end electrodes on a dual electrode gas discharge tube to the middle of the gas discharge tube. By varying the base switching frequency of the supply, the bubble effect which plagues some displays can be eliminated.

BRIEF DESCRIPTION OF THE DRAWINGS

In the drawings, where like numerals describe like components throughout the several views.

DETAILED DESCRIPTION OF THE PREFERRED EMBODIMENT

In the following detailed description of the preferred embodiments, reference is made to the accompanying drawings which form a part hereof, and in which is shown by way of illustration specific embodiments in which the invention may be practiced. These embodiments are described in sufficient detail to enable those skilled in the art to make and practice the invention, and it is to be understood that other embodiments may be utilized and that structural, electrical or logical changes may be made without departing from the scope of the present invention. The following detailed description is, therefore, not to be taken in a limiting sense, and the scope of the present invention is defined only by the appended claims.

Figure 1:
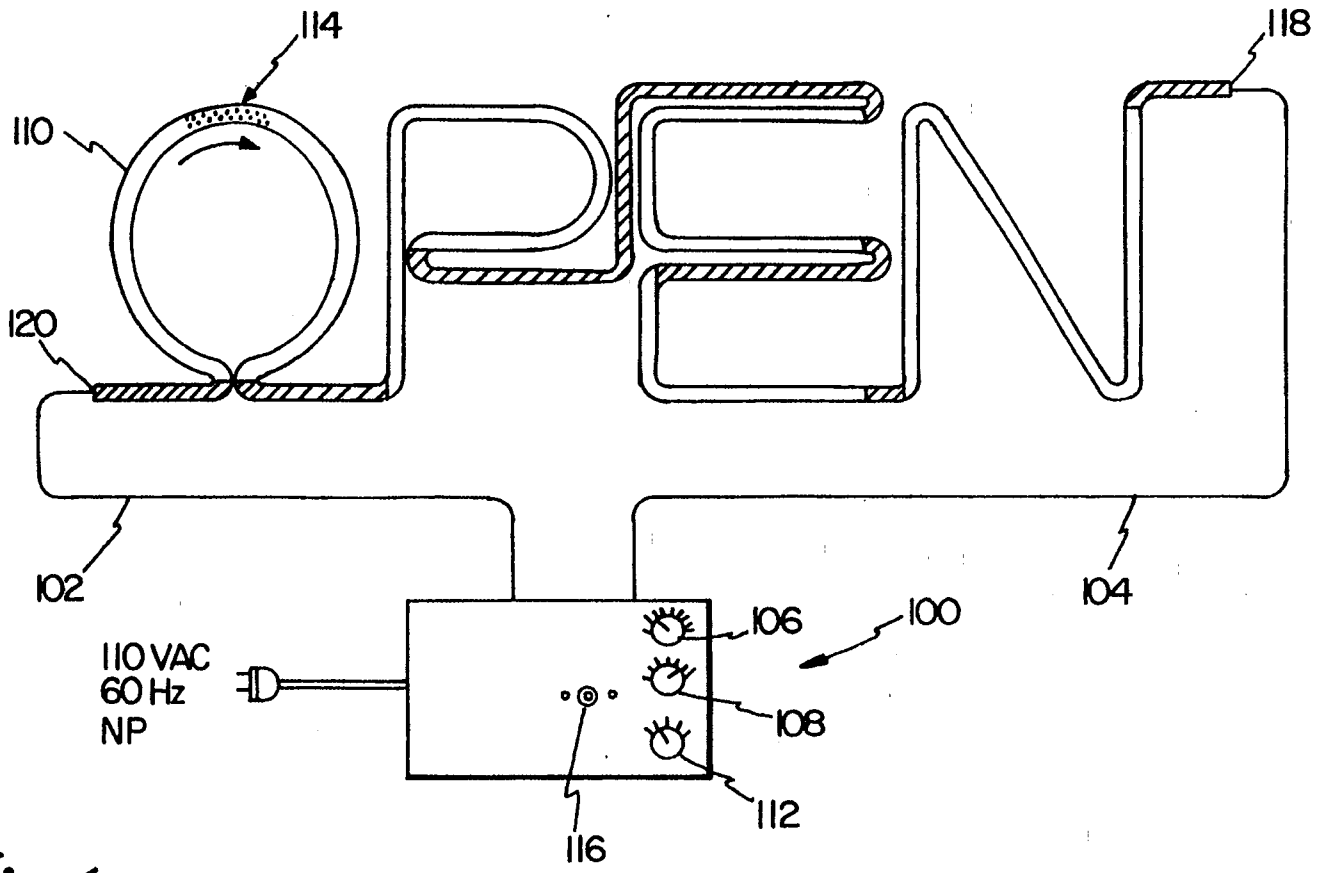
FIG. 1 shows an application of the present invention for driving a dual electrode gas discharge tube sign.

Referring to FIG. 1, a gas discharge tube 110 is shown driven by a switching power supply 100. In a preferred implementation of the present invention, a neon tube shaped in the form of an OPEN sign is driven from supply 100. Those skilled in the art both readily recognize that a wide variety of shapes of gas discharge tubes and preferred gases used in the discharge tubes could be substituted for the tube 110 shown in FIG. 1.

The switching supply 100 shown in FIG. 1 has in the preferred embodiment three variable potentiometers 106, 108 and 112. Potentiometer 106 varies the base frequency of the switching supply which is used to excite tube 110. Potentiometer 108 varies the sweep rate at which the base frequency is swept by the switching supply 100. Potentiometer 112 varies the sweep width of the sweep signal used to sweep the base frequency. Switch 116 (S1 in FIG. 2) produces a triangle wave as the sweep signal where open and switch 116 produces a ramp signal with switch 116 closed.

The crawling effect is illustrated by excitation fronts 114 and 115 of tube 110. With the switching supply connected to the gas discharge tube 110, the swept frequency of the applied voltage causes the tube to excite near electrodes 120 and 118 at the high frequency portion of the sweep signal (which corresponds to minimum output voltage from supply 100) while moving along the tube at locations 114 and 115 as the sweep frequency decreases. At the lowest portion of the sweep frequency (which corresponds to the maximum output voltage from supply 100) the excitation portions 114 and 115 of tube 110 reach the center of tube 110, at which point the entire tube is excited. The excitation fronts 114 and 115 correspond to the lowest frequency when it reaches the center of the gas discharge tube.

When the excitation points 114 and 115 reach the center, the tube can be darkened by two preferred methods. The first method would be to allow the sweep frequency to rise back up again causing excitation fronts 114 and 115 to crawl from the center to electrodes 118 and 120 along tube 110. This would correspond to the triangle wave in which the base frequency is swept up in frequency and back down again. The second preferred method of de-sweeping the driving excitation signal for tube 110 would be to use a ramp wave as the sweep control signal. In this fashion when the excitation portions 114 and 115 reach the center (corresponding to the minimum switching frequency and the maximum supply voltage on the output of supply 100), the base frequency quickly rises again to the highest frequency (corresponding to the minimum supply voltage on the output of supply 100) causing the tube to go dark. After the tube is allowed to go dark, and having all excitation within the tube stopped, the base frequency is slowly ramped up (swept up) once again to effect crawling from end electrodes 120 and 118 on tube 110. The range of the swept base frequency in the preferred embodiment is approximately 80 kHz to 15 kHz.

Figure 2:
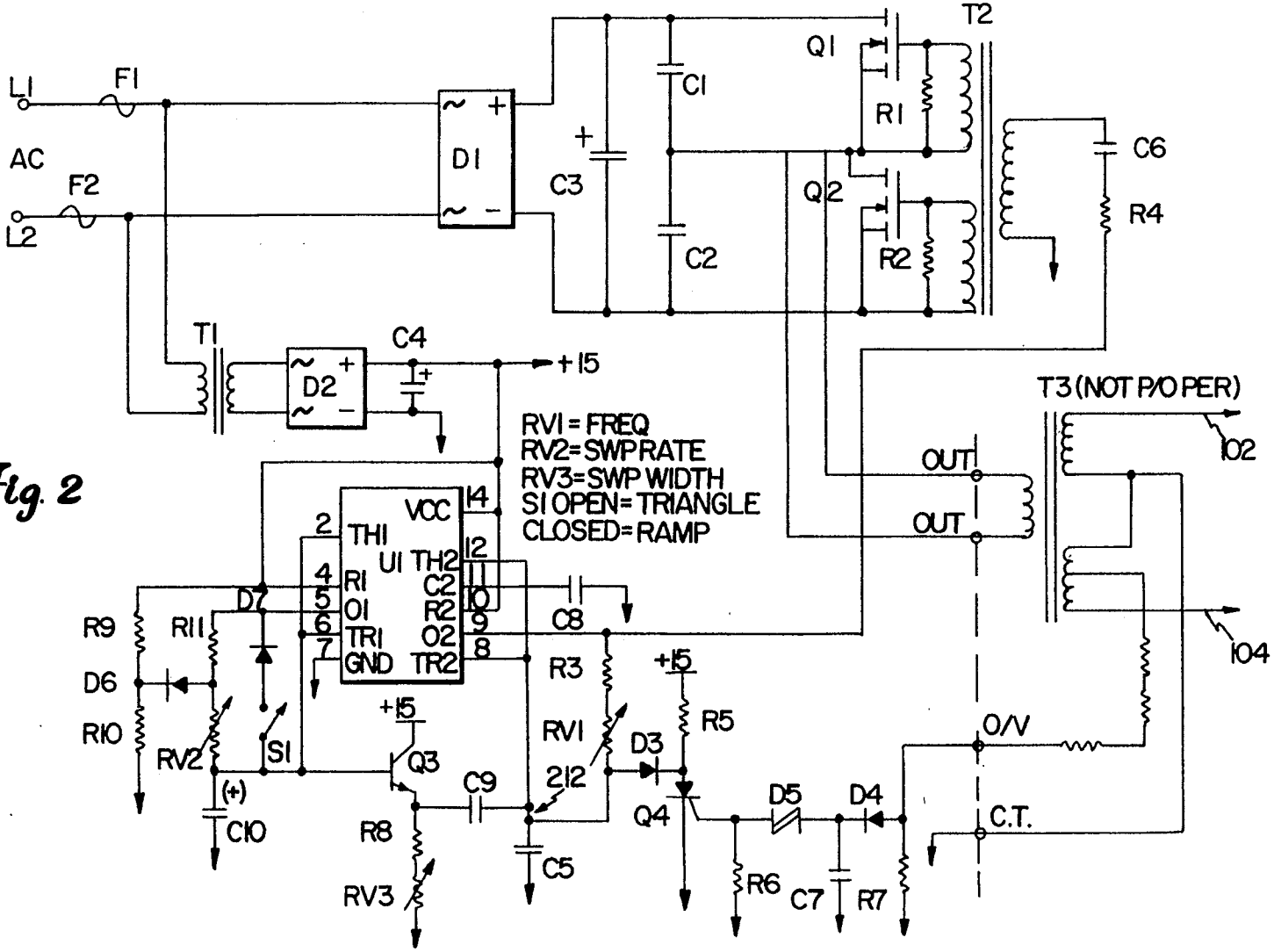
FIG. 2 is a detailed electrical schematic diagram of a swept frequency switching power supply for driving a gas discharge tube.

FIG. 2 is a detailed electrical schematic diagram describing the preferred embodiment of the present invention for driving gas discharge tubes. Table 1 describes the component values and part numbers shown in FIG. 2. A non-polarized AC voltage is applied to input lines L1 and L2. Fuse F1 is used to fuse line L1. Those skilled in the art will readily recognize a wide variety of circuit protection schemes that could be used to protect the circuits from the AC line shown in FIG. 2.

The line voltage is applied directly to a full wave diode bridge D1. The rectified voltage on the outputs bridge D1 represent the main current carrying path for the switching circuit used to switch the DC through transformer T3 where it is applied to a gas discharge tube through lines 102 and 104. The directly rectified voltage on the output of bridge D1 is applied to electrolytic capacitor C3. Capacitor C3 provides a high degree of filtering to provide a filtered DC for switching through transformer T3. The input impedance of the primary of transformer T3 taken in conjunction with capacitors C1 and C2 form a resonant converter circuit which switches the DC power to the secondary of stepup power transformer T3. The input impedance seen at the input terminals of the primary of transformer T3 taken in conjunction with the capacitance values of capacitor C1 and C2 form the resonant converter. The optimal transfer point for transferring power therefor through transformer T3 is the combination of the inductance and capacitance.

TABLE 1

| PARTS LIST FOR CIRCUIT OF FIG. 2 | |
|---|---|
| F1 | Fuse, 7A, 125 |
| D1 | Rectifier Bridge, 6A, 600 V. |
| D2 | Rectifier Bridge, 1A, 100 V. |
| T1 | Step-Down Transformer, 120 V pri., 17 V sec. |
| T2 | Gate Drive Transformer, Toroid, 40 turn pri., 65 turn sec. |
| T3 | Output Transformer, 60 turn pri., 4,000 sec. |
| C1 | Capacitor, 1 μf, 250 V film. |
| C2 | Capacitor, 1 μf, 250 V film. |
| C3 | Capacitor, Electrolytic, 270 μf, 200 V. |
| C4 | Capacitor, Electrolytic, 150 μf, 50 V. |
| C5 | Capacitor, .001 μf, 50 V, film. |
| C6 | Capacitor, 1 μf, 50 V, film. |
| C7 | Capacitor, .02, 50 V, film. |
| C8 | Capacitor, .1 μf, 50 V, film. |
| C9 | Capacitor, .033 μf, 50 V, film. |
| C10 | Capacitor, 100 μf, 50 V, Electrolytic. |
| R1 | Resistor, 1500 ohm, ¼watt. |
| R2 | Resistor, 1500 ohm, ¼watt. |
| R3 | Resistor, 1000 ohm, ¼watt. |
| R4 | Resistor, 22 ohm, ¼watt. |
| R5 | Resistor, 1200 ohm, ¼watt. |
| R6 | Resistor, 400 ohm, ¼watt. |
| R7 | Resistor, 80,000 ohm, ¼watt. |
| R8 | Resistor, 3000 ohm, ¼watt. |
| R9 | Resistor, 5100 ohm, ¼watt. |
| R10 | Resistor, 10,000 ohm, ¼watt. |
| R11 | Resistor, 27,000 ohm, ¼watt. |
| RV1 | Potentiometer, 5000 ohm. |
| RV2 | Potentiometer, 50,000 ohm. |
| RV3 | Potentiometer, 5,000 ohm. |
| S1 | Switch, SPST. |
| D3 | Switching Diode, 100 V. |
| D4 | Switching Diode, 100 V. |
| D5 | DIAC, HT-32 |
| D6 | Switching Diode, 100 V. |
| D7 | Switching Diode, 100 V. |
| U1 | Dual Timer Chip, 556. |
| Q1 | Power MOSFET, IRF640. |
| Q2 | Power MOSFET, IRF640. |
| Q3 | Transistor, 2N3904 |
| Q4 | SCR, 2N5601. |
| R12 | Resistor, 3.3 megohms, ¼watt |
| R13 | Resistor, 3.3 megohms, ¼watt |
| R14 | Resistor, 3.3 megohms, ¼watt |

Those skilled in the art will readily recognize that a gas discharge tube connected to lines 102 and 104 of the secondary of transformer T3 will also have an impedance which will be reflected through the transformer and seen on the primary terminals of transformer T3. The impedance of the gas discharge tube connected to terminals 102 and 104 will contribute to the impedance seen looking into the primary of transformer T3. Thus the impedance of the gas discharge tube connected to lines and 104 of the switching supply will effect the optimal power transfer point based on the switching frequency of the resonant converter. Depending upon the value of this impedance, the optimal switching frequency must be selected to effect the best possible power transfer. By varying the switching frequency the output voltage may be varied between 4 kilovolts and 15 kilovolts depending upon the impedance of the gas discharge tube connected between lines 102 and 104.

The voltage switched through the resonant converter on power transformer T3 is switched through power MOSFETs Q1 and Q2. The gates of these MOSFETs are controlled such that neither MOSFET is on at the same time. The alternating switching of the gates of transistors Q1 and Q2 vary the direction of current through the primary of transformer T3. The alternate switching of transistors Q1 and Q2 cause a resonant current to develop in the primary which is in turn transferred to the secondary of transformer T3 and on to discharge tube 110 connected to output terminals 102 and 104. Control of the power MOSFETs Q1 and Q2 is effected by the switching control circuit attached to the base of those transistors.

The switching control transformer T2 is connected between the base terminals of power MOSFETs Q1 and Q2 and ground. The primary of transformer T2 is controlled by an oscillator circuit shown in the lower left portion of FIG. 2.

In the preferred embodiment of the present invention the main controller for establishing the switching frequencies is by means of a dual timer circuit U1 which is in the preferred embodiment Part No. LM556 available from National Semiconductor and a wide variety of other vendors. This timer circuit U1 contains two individual timing mechanisms for establishing the switching and sweeping frequencies. Those skilled in the art will recognize that a wide variety of timer circuits could be substituted for the timing circuits of the present invention without departing from the spirit and scope of the present invention.

The dual timer U1 forms the basis of an oscillator which produces a base frequency. The base frequency can be controlled by potentiometer RV1. This base frequency can be swept from a high frequency to a lower frequency thus causing the switching frequency of transformer T3 to vary from a high frequency to a low frequency of approximately 80 kHz to 15 kHz. This variable sweep frequency causes a variable voltage to be applied between terminals 102 and 104 which depends of course upon the impedance of the gas discharge tube attached thereto. Due to the variable impedance of the gas discharge tubes, the base frequency must first be selected for the optimal brightness of the tube when excited. The rate at which the base frequency is swept from a high frequency to a low frequency (the repetition rate) is controlled by potentiometer RV2. The sweep width, that is the frequency range from low to high of the swept base frequency is controlled by potentiometer RV3.

Referring once again to FIG. 2, integrated circuit U1 is in the preferred embodiment Part No. LM556 available from National Semiconductor. This integrated circuit is a dual timing circuit which includes two type LM555 timers. The 555 timer is a well known timing circuit which is operable in monostable or astable mode at selectable frequencies and which can be used to implement timing circuits and oscillators. The 555 timer is a highly stable controller capable of producing time delays or oscillations based on external discrete components. The first timing circuit of integrated circuit U1 uses pins 8 through 13 while the second timing circuit uses pins 2 through 7. Pin 7 is reserved for ground and pin 14 is reserved for $V_{cc}$ which in the preferred embodiment is a positive 15 volts. The $V_{cc}$ supply current is provided by a simple DC voltage rectifier circuit connected to the AC line L1 and L2. Transformer T1 is a small stepdown transformer which reduces the line voltage to approximately 12 volts AC. The AC stepdown voltage from the secondary of transformer T1 is applied through full wave diode bridge D2 where the output is applied to filter capacitor C4. The resulting voltage is approximately 15 volts DC.

The dual 555 timing circuits contained in the LM556 integrated circuit U1 are each operable in astable mode in which the frequency and duty cycle of the outputs of these circuits is controlled with external resistors and capacitors. The 555 timer connected through pins 8 through 13 of U1 operate as a controlled oscillator while the timing circuit through pins 2 through 7 of integrated circuit U1 operates as a linear astable function generator. This function generator can produce a linear triangle waveform or a ramp waveform of variable repeating frequency. The frequency of the repeating waveform is controlled by an RC time constant comprised of resistor R11 in series with potentiometer RV2 and capacitor C10. The rate of charging and discharging of capacitor C10 can be varied by potentiometer RV2 thereby varying the sweep frequency. The positive side of electrolytic capacitor C10 is tied to the trigger and threshold inputs of the first 555 timer circuit of U1. Thus, the rate at which the voltage varies up and down on capacitor C10 controls the rate at which the first 555 timer circuit of integrated circuit U1 operates. The output of the first timing circuit on line $O_1$ provides the charging and discharging current for capacitor C10 through resistor R11 and potentiometer RV2. The voltage point at which the timing circuit resets is controlled through resistor ladder R9 and R10 connector to the cathode of diode D6. Thus the resetting of the first 555 timer in integrated circuit U1 is set by resistor ladder R9–R10 without contributing any charging or discharging current of capacitor C10.

The voltage on capacitor C10 can be caused to rise and fall either in a triangle waveform or a ramp waveform. A triangle waveform characterized by a constant rising slope of voltage to a peak voltage followed by constant reciprocal slope of lowering voltage. A ramp waveform is characterized by a linear slope of rising voltage to a peak which abruptly drops to zero voltage to start the positive-going ramp over again. Switch S1 controls the type of discharge of capacitor C10 which therefor controls whether the voltage on capacitor C10 is a triangle waveform or a ramp waveform. With S1 in the open position a triangle waveform is produced on capacitor C10. With S1 in a closed position a fast discharge path is provided through diode D7 which discharges capacitor C10 to produce a rapid drop in voltage after the peak.

The voltage waveform (either triangle wave or ramp) applied to the base of bipolar NPN transistor Q3. The signal applied to the base of transistor Q3 controls the frequency produced on output $O_2$ of the second timing circuit of integrated circuit U1. Threshold $TH_2$ and trigger $TR_2$ are tied together controlling the frequency on the output $O_2$ of the second timer circuit. Capacitor C5 is the primary timing capacitor which when combined with resistor R3 and potentiometer RV1 form an RC timing circuit which selects the frequency output on output $O_2$.

Output $O_2$ is a substantial square wave which is applied to the primary of transformer T2. This is the control signal used for controlling power MOSFET transistors Q1 and Q2 through the dual matched secondaries of transformers T2. The windings of the secondary transformer T2 are in opposite polarity ensuring that when transistor Q1 is on transistor Q2 is off. In this fashion transistors Q1 and Q2 are mutually exclusive in their on and off times.

The switching signal changes its frequency according to the charge and discharge rate on capacitor C5. Since the voltage on the threshold and trigger inputs to the timer circuit controls the output voltage, the voltage at the node connecting capacitor C5 and C9 directly controls the frequency on output $O_2$. In this fashion the timer operates as a voltage controlled oscillator (VCO) and is capable of swept frequency operation depending on the change of voltage input to trigger and threshold inputs $TR_2$ and $TH_2$ respectively.

Contributing to the voltage at node connection 212 referenced to ground is the voltage across capacitor C9. Transistor Q3 being controlled by the first timer circuit applies either a triangle wave or ramp signal which changes the voltage across capacitor C9 reference between node 212 and the emitter of transistor Q3. This voltage thus adds or subtracts to the ground reference potential at node 212 and thus contributes or detracts from the voltage used to control the voltage controlled oscillator implementation in the second timer circuit. Thus a swept frequency which changes the frequency from a base frequency (determined by potentiometer RV1 to a higher frequency is output on output $O_2$ and applied to control switching transistors $Q_1$ and $Q_2$.

The switching signal applied to transformer T2 controls the application of switch current through the primary of high voltage transformer T3. The actual current transfer through transformer T3 and hence the voltage on outputs 102 and 104 of the secondary of transformer T3 is partially dependent on the input impedance of the gas discharge tube attached to connections 102 and 104. Should an open condition exist between secondary outputs 102 and 104 of transformer T3, the voltage on the output tends to "runaway" and a very high voltage approaching a breakover or breakdown voltage will occur. In order to prevent this overvoltage situation, one of the windings of the secondary of transformer T3 is tapped and used for an overvoltage shutdown circuit. The main component of the overvoltage shutdown circuit is silicon controlled rectifier (SCR) Q4. This SCR tends to ground node 212 when turned on such that the switching frequency on the output $O_2$ of the second timer circuit is shut off thereby shutting down the switching transistors Q1 and Q2 in a very fast fashion to prevent overvoltage breakdown.

The trigger input of SCR Q4 is turned on when and overvoltage condition exists across diac diode D5. Diac diode D5 determines a breakover or threshold voltage which will be used for triggering SCR Q4 and therefor shutting down the circuit. Those skilled in the art will readily recognize that the overvoltage shutdown circuit can be constructed using components designed to shutdown the circuit at selected voltage thresholds depending on the maximum allowable voltage on the output of high voltage transformer T3.

The construction of transformers T1, T2 and T3 shown in FIG. 1 are within the skill of those practicing in the art. Transformers T1 and T2 may be commonly available transformers or they may be specially constructed according to the specific application of this device. Control transformer T2 is, in the preferred embodiment, a 70 turn primary with two 100 turn secondaries, creating a 1.7:1.0 transfer ratio. The primary and secondaries are wound using 36 gauge wire on a common core bobbin.

Power transformer T3 is of a more exact construction due to the high voltage multiplication on the secondary. The primary is constructed with 75 turns of number 22 single insulated stranded wire wound around a high voltage isolation core very similar to those used in the flyback transformers of television sets. The secondaries are wound on a high isolation core comprised of approximately 4,000 turns of number 35 wire. The secondaries are separated into a plurality of segmented windings to reduce the chance of arcing between the windings and allows operation at high frequencies by reducing the capacitance between the windings. For example, the secondary could be segmented into 6 to 8 separate windings separated by suitable insulation to prevent arcing and potted in commonly available insulating plastic to minimize arcing.

In operation, the power supply of FIG. 1 is attached to the AC mains through lines $L_1$ and $L_2$. A gas discharge tube containing neon or argon-mercury is attached between the output terminals 102 and 104 of power transformer T3. For initial setup, variable resistor RV1 is turned fully counter-clockwise to cause a low frequency of the switching supply resulting in a low output voltage. The variable resistor RV1 is then turned clockwise until the desired brightness is obtained on the tube 110.

In the preferred embodiment of the present invention, a short may be maintained between outputs 102 and 104 indefinitely without causing damage to the supply. If, however, the supply 100 is energized with no load placed between 102 and 104, the output voltage will tend to runaway due to an infinite impedance on the secondary of transformer T3. To prevent overvoltage runaway, the overvoltage shutdown portion of the circuit of FIG. 1 is used to shutdown the oscillator, as described above.

While the present invention has been described in connection with the preferred embodiments thereof, it will be understood that many modifications will be readily apparent to those of ordinary skill in the art and this application is intended to cover any adaptations or variations thereof. Therefore, it is manifestly intended that the invention be limited only by the claims and the equivalents thereof.

What is claimed:

1. An excitation power supply device for use with a two electrode gas discharge robe having an impedance, comprising:

oscillator means for electrically producing a switching signal having a selectable frequency;

function generator means electrically connected to the oscillator means for continuously and repeatably sweeping the selectable frequency and for producing therefrom a switching signal having a swept frequency at a first voltage;

conversion means including a transformer electrically connected to the generator means for electrically receiving the switching signal said conversion means operable for producing second voltage higher than the first voltage wherein the second voltage being affected by the swept frequency and the impedance of the gas discharge tube; and means for electrically connecting the conversion means between the electrodes of the gas discharge tube.

2. The device according to claim 1 wherein the conversion means includes the power transformer driven in a resonant converter circuit.

3. The device according to claim 1 further including adjusting means connected to the function generator means for varying the rate at which the selectable frequency is swept.

4. The device according to claim 1 further including adjusting means connected to the oscillator means for selecting a base frequency of the switching signal.

5. An excitation power supply device for producing a crawling effect in a two-electrode gas discharge tubes having an impedance, comprising:

an oscillator having a selectable first frequency;

a sweep circuit electrically connected to the oscillator including a sweep control means for sweeping the selectable first frequency at a second frequency and for producing therefrom a swept frequency switching signal at a first voltage;

a resonant conversion circuit including a step-up transformer, a primary winding of the step-up transformer being electrically connected for receiving the swept frequency switching signal and the secondary winding of the step-up transformer being electrically connected for producing an excitation voltage at a second voltage which is higher than the first voltage, the second voltage being affected by the swept frequency switching signal and the impedance of the gas discharge tube; and means for connecting the secondary winding of the step-up transformer between the two electrodes of the gas discharge tube.

* * * * *

UNITED STATES PATENT AND TRADEMARK OFFICE

CERTIFICATE OF CORRECTION

PATENT NO. : 5,386,181

DATED : January 31, 1995

INVENTOR(S) : Edward D. Orenstein

It is certified that error appears in the above-identified patent and that said Letters Patent is hereby corrected as shown below:

Cover page, second column, line11, delete "5/1988" and insert therefor --10/1986--.

Cover page, second column, line 13, delete "9/1989" and insert therefor --11/1987--.

Cover page, second column, line 16, delete "Tack" and insert therefor --Taek--.

Column 1, lines 66-67, delete "is that means" and insert therefor -- is that the means--.

Column 2, line 5, delete "sections a gas" and insert therefor --sections of a gas--.

Column 2, line 26, delete "specification. The" and insert therefor --specification, the--.

Column 3, line 16, delete "where open" and insert therefor --when open--.

Column 4, line 68, delete "lines and 104" and insert therefor --lines 102 and 104--.

Column 7, line 34, delete "RV1 to" and insert therefor --RV1) to--.

Column 8, line 65, delete "the generator" and insert therefor --the function generator--.

Column 9, line 4, delete "the electrodes" and insert therefor --the two electrodes--.

Signed and Sealed this

Thirty-first Day of December, 1996

*Attest:*

Bruce Lehman

BRUCE LEHMAN

*Attesting Officer*

*Commissioner of Patents and Trademarks*